US008387320B2

(12) United States Patent
Furgerson et al.

(10) Patent No.: US 8,387,320 B2
(45) Date of Patent: Mar. 5, 2013

(54) BUILDING CLOSURE WITH ENHANCED MOISTURE BARRIER PROPERTIES

(75) Inventors: David Furgerson, Sammamish, WA (US); Julian Giggs, Hillsdale, MI (US); Nirav D. Parikh, Sylvania, OH (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 291 days.

(21) Appl. No.: 12/648,536

(22) Filed: Dec. 29, 2009

(65) Prior Publication Data

US 2011/0154753 A1 Jun. 30, 2011

(51) Int. Cl.
*E06B 7/14* (2006.01)

(52) U.S. Cl. ..... 52/209; 52/204.51; 52/214

(58) Field of Classification Search ..... 52/209, 52/207, 204.5, 204.51, 204.55, 214; 49/408
See application file for complete search history.

(56) References Cited

U.S. PATENT DOCUMENTS

| | | | | |
|---|---|---|---|---|
| 3,859,754 | A * | 1/1975 | Budich et al. | 49/425 |
| 4,132,035 | A | 1/1979 | Frambach | |
| 4,432,179 | A | 2/1984 | Bachmann | |
| 4,527,368 | A | 7/1985 | Jentoft | |
| 5,768,836 | A | 6/1998 | Bachman | |
| 6,182,405 | B1 | 2/2001 | Lindahl | |
| 6,922,958 | B2 * | 8/2005 | Derderian | 52/204.55 |
| 8,015,764 | B2 * | 9/2011 | Yun | 52/209 |
| 8,033,056 | B2 * | 10/2011 | Wernlund et al. | 49/408 |
| 2003/0056450 | A1 * | 3/2003 | Bealko | 52/204.55 |
| 2003/0230034 | A1 * | 12/2003 | Lapierre | 52/204.5 |
| 2005/0050815 | A1 * | 3/2005 | Engebretson | 52/204.52 |
| 2006/0080902 | A1 | 4/2006 | Bren | |
| 2006/0096193 | A1 * | 5/2006 | Ohrstrom | 52/204.5 |
| 2007/0056230 | A1 | 3/2007 | Bren | |

FOREIGN PATENT DOCUMENTS

GB 2019474 10/1979

* cited by examiner

*Primary Examiner* — Branon Painter
(74) *Attorney, Agent, or Firm* — Reising Ethington

(57) ABSTRACT

A building closure for mounting within an opening in a building wall structure includes a frame for mounting within the wall structure opening and at least one closure unit for mounting within the frame. The frame has at least one interior chamber extending entirely around the frame and a nailing flange for securement to the building wall structure such that at least a portion of the frame is disposed within the building wall opening. There is a cavity between at least one exterior surface of the frame and the inner periphery of the building wall opening, with the cavity extending along at least a top portion of the frame. A barrier extends along at least the top portion of the frame to retard passage of moisture from the cavity to the building interior. At least one moisture weep opening is disposed in the top portion of the frame from the cavity to the interior chamber of the frame such that moisture in the cavity flows through the weep opening into the chamber, within the chamber around the frame and then out of a drain opening in a bottom portion of the frame.

9 Claims, 6 Drawing Sheets

BUILDING CLOSURE WITH ENHANCED MOISTURE BARRIER PROPERTIES

The present disclosure relates to a building closure such as a window or sliding door, and more particularly to an improved barrier against ingress of moisture around the periphery of the closure into the building interior.

BACKGROUND AND SUMMARY OF THE DISCLOSURE

Building closures typically include a frame for mounting within a building wall structure opening and at least one closure unit, such as a window or sliding door unit, for mounting within the frame. The frame has an exterior nailing flange for securing the frame to the building wall structure. Moisture can enter the cavity between the closure frame and the surrounding wall opening and pass into the building interior due to air pressure dynamics on the closure. A general object of the present disclosure is to provide a mechanism by means of which such passage of moisture to the building interior is retarded, and moisture is collected and drained to the building exterior.

The present disclosure embodies a number of aspects that can be implemented separately from or in combination with each other.

A building closure for mounting within an opening in a building wall structure, in accordance with one aspect of the present disclosure, includes a frame for mounting within the wall structure opening and at least one closure unit for mounting within the frame. The frame has at least one interior chamber extending entirely around the frame and a nailing flange for securement to the building wall structure such that at least a portion of the frame is disposed within the building wall opening. There is a cavity between at least one exterior surface of the frame and the inner periphery of the building wall opening, with the cavity extending along at least a top portion of the frame. A barrier extends along at least the top portion of the frame to retard passage of moisture from the cavity to the building interior. At least one moisture weep opening is disposed in the top portion of the frame from the cavity to the interior chamber of the frame such that moisture in the cavity flows through the weep opening into the chamber, within the chamber around the frame and then out of a drain opening in a bottom portion of the frame.

The barrier preferably includes a wall extending from at least the top portion of the frame toward the inner periphery of the building wall opening. The wall in an exemplary embodiment of the disclosure includes a flexible seal wall carried by at least the top portion of the frame for engagement with the inner periphery of the building opening. The flexible seal wall preferably extends along top and side portions of the frame toward the inner periphery of the building wall. There preferably also is a seal on an inner surface of the nailing flange for engagement with an opposing surface of the building wall structure to retard ingress of moisture between the nailing flange and the building wall structure into the cavity.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
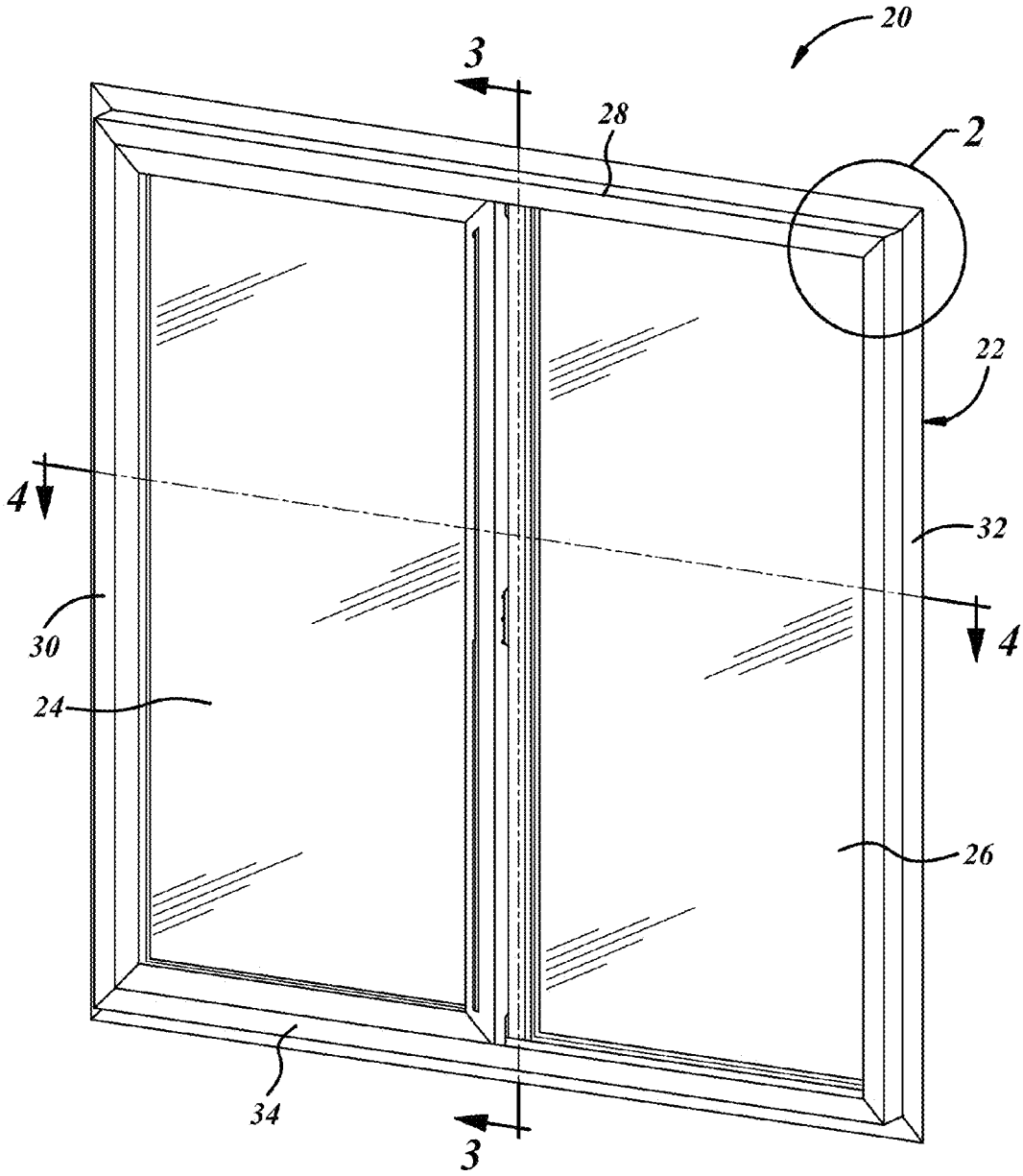
FIG. 1 is a perspective view of a building closure in the form of a sliding window assembly in accordance with an exemplary embodiment of the present disclosure.

FIGS. 1-4 and 7 illustrate a window assembly 20 in accordance with an exemplary embodiment of the disclosure as including a frame 22 and a pair of window units 24, 26 mounted within frame 22. In the exemplary embodiment, window unit 26 is a fixed window unit and window unit 24 is an operable sliding window unit. However, the present disclosure is by no means limited to closures of this type, but also encompasses closure assemblies such as sliding door units, vertical window units and a closure comprising a single fixed window unit or sash mounted within a frame.

Frame 22 preferably comprises a plurality of rails 28, 30, 32, 34 of rigid construction secured end-to-end. Rails 28, 30, 32, 34 preferably are of extruded vinyl construction, but could be of wood, aluminum, fiberglass or other plastic construction. Rails 28, 30, 32, 34 can be joined by welding mitered ends of the rails to each other, or by other joining means known in the art such as corner keys. In the exemplary embodiment illustrated in the drawings, the frame 22 is of rectangular construction. However, non-rectangular frame constructions can be employed, such as a gable frame having one or more angled top rails or a radius frame having a curved top rail. Window units for such frames may comprise a single non-movable sash.

Figure 2:
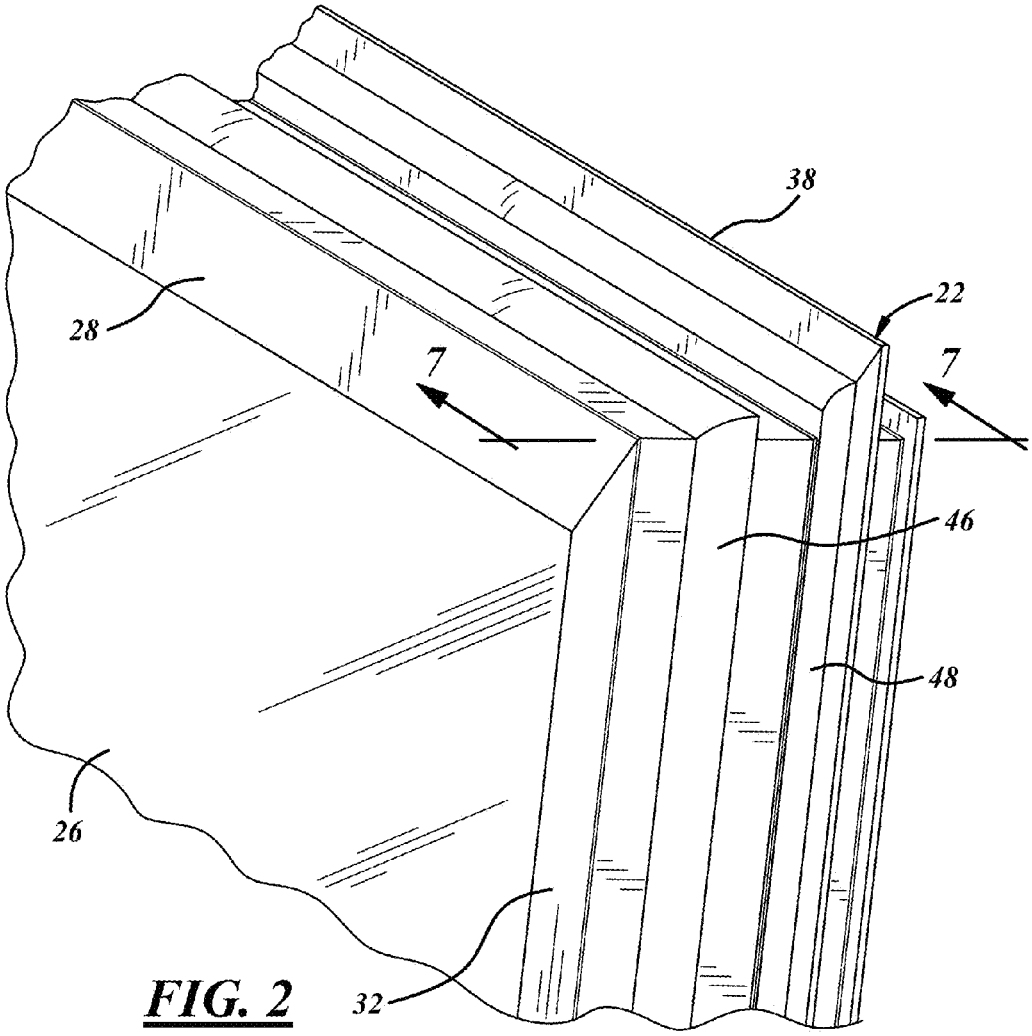
FIG. 2 is an enlarged perspective view of the portion of FIG. 1 within the area 2.
Figure 3:
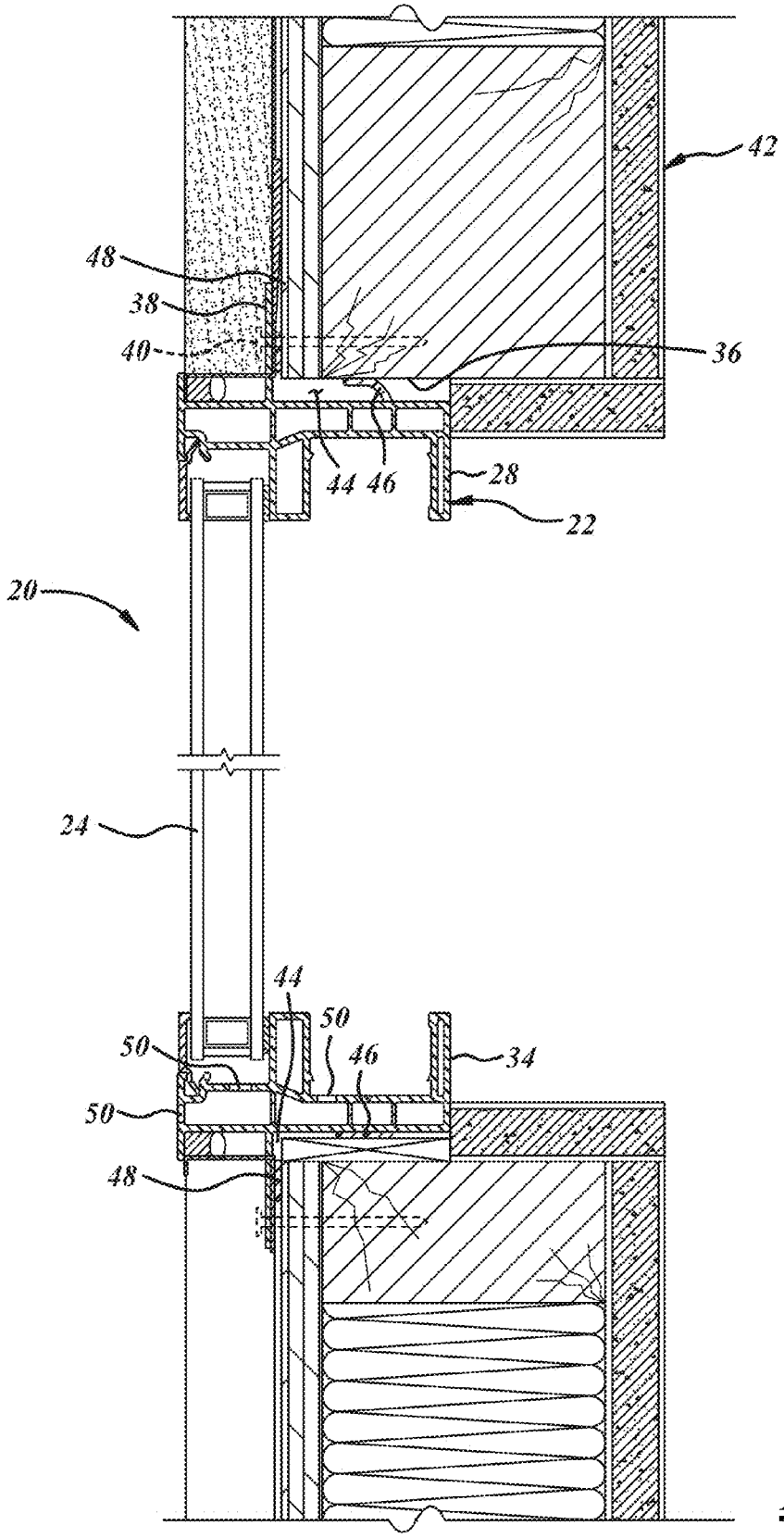
FIG. 3 is a sectional view taken substantially along the line 3-3 of FIG. 1 and showing the window of FIG. 1 mounted within a building wall opening.
Figure 4:
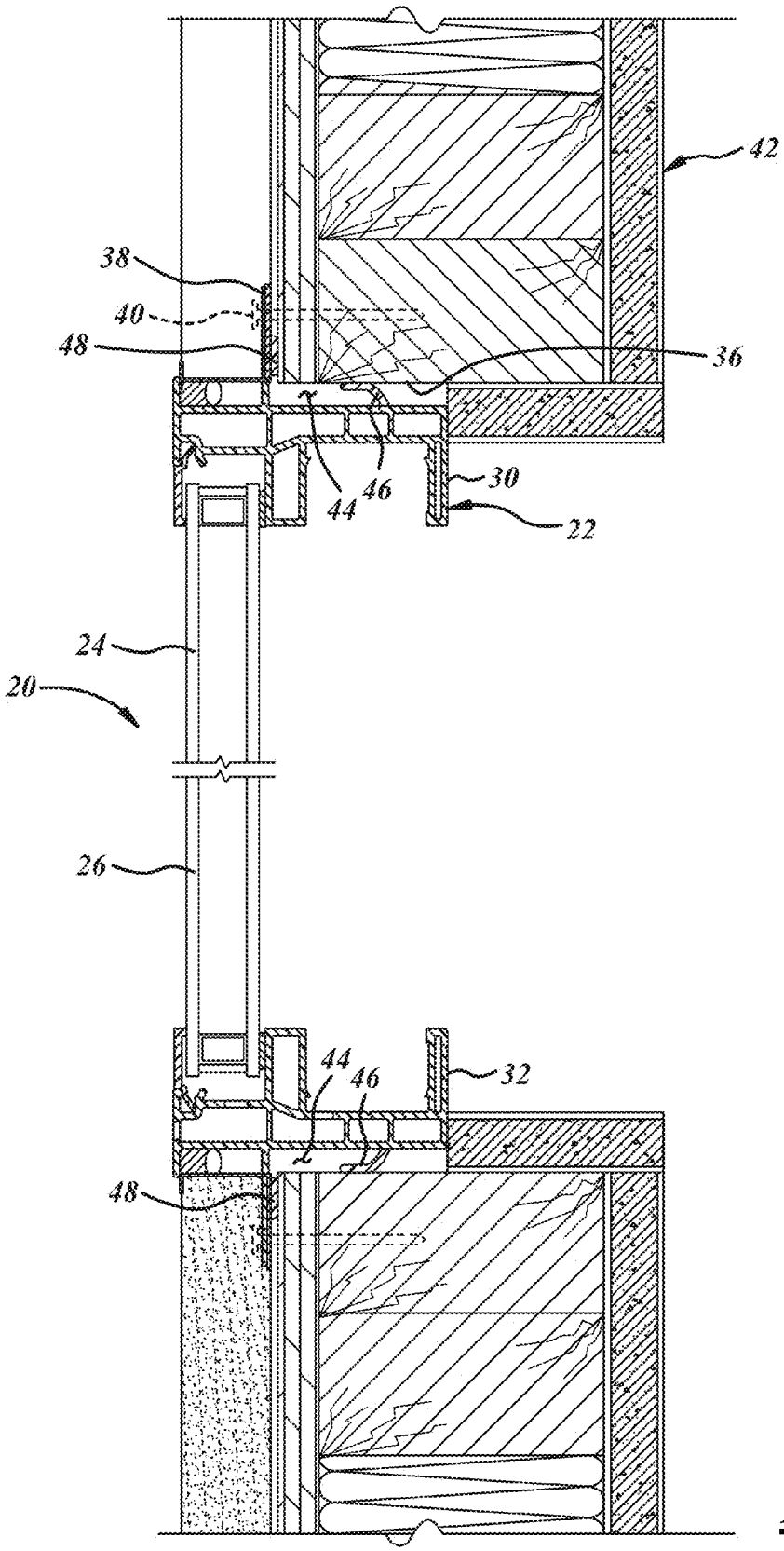
FIG. 4 is a sectional view taken substantially along the line 4-4 of FIG. 1 and showing the window of FIG. 1 mounted within a building wall opening.

FIGS. 3 and 4 illustrate window 20 installed in an exemplary building wall opening 36. Frame 22 has a nailing flange 38, which preferably extends entirely around the frame (FIGS. 1 and 2). The nailing flange consists of several segments each integral with an associated rail. The nailing flange segments preferably are mitered to form a continuous flange 38 when the rails are joined together. At least one fastener 40 (typically a plurality of fasteners) extends through nailing flange 38 to secure frame 22 and window 20 to the building wall structure 42 such that at least a portion of frame 22 is disposed within opening 36. Details of wall structure 42 illustrated in FIGS. 3 and 4 (and in FIG. 6) are exemplary only. The term "nailing flange" does not imply that fasteners 40 must be nails, and other fasteners such as screws or staples could be employed.

Figure 7:
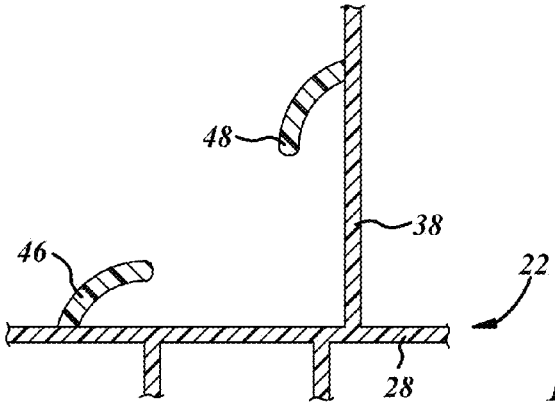
FIG. 7 is a fragmentary sectional view taken substantially along the line 7-7 in FIG. 2.

With window frame 22 mounted within opening 36, a void or cavity 44 is formed between the exterior periphery of frame 22 and at least the top and side portions of opening 36 (FIGS. 3 and 4). As is well known in the art, exterior wind and atmospheric dynamics create an elevated pressure within cavity 44. In accordance with the present disclosure, a barrier wall 46 is carried by frame 22 around at least the top and side portions of the exterior periphery of the frame to retard passage of moisture from cavity 44 to the building interior. That is, barrier wall 46 is carried on the exterior surfaces of at least top and side rails 28, 30, 32 of frame 22. A barrier wall 46 preferably also is carried by bottom rail 34, as best seen in FIG. 3. Barrier wall 46 may be relatively short since the objective is to prevent flow of moisture along the outer surfaces of the frame rails. However, in the illustrated embodiment, each barrier wall 46 takes the form of a flexible resilient wall sized for opposed engagement with the surrounding inner periphery of wall opening 36. Barrier wall 46 may be arcuate, as best seen in FIG. 7, curving outwardly toward nailing flange 38 to facilitate insertion into window opening 36. Barrier wall 46 can be assembled or otherwise suitably secured to the exterior of frame 22. In the preferred embodiment of the disclosure in which the frame rails are of extruded plastic construction, barrier wall 46 preferably is coextruded with the rails, and mitered and joined end-to-end as illustrated in FIG. 2. Barrier wall 46 can be of any suitable construction such as flexible resilient PVC.

The exemplary embodiment of FIGS. 1-4 and 7 also includes a flexible resilient seal wall 48 on an interior surface of nailing flange 38 for opposed engagement with a surface of wall structure 42 to retard ingress of moisture into cavity 44. Seal wall 48 preferably is of flexible resilient construction such as PVC, and most preferably is coextruded with plastic rails 28, 30, 32, 34. Once again, however, other techniques can be employed for securing seal wall 48 to nailing flange 38. Lower rail 34 of frame 22 includes weep (drain) openings 50 for routing moisture to the building exterior.

Figure 5:
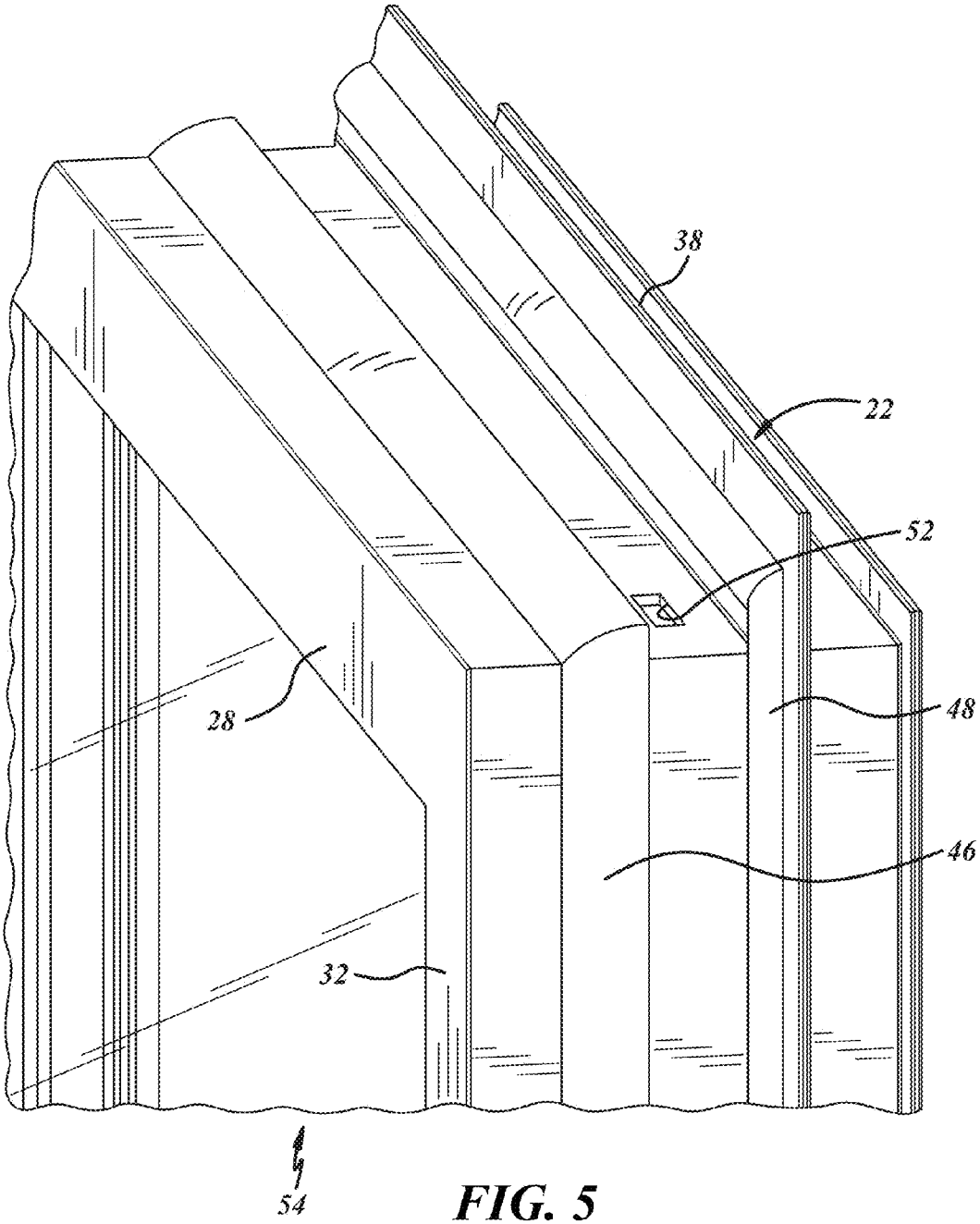
FIG. 5 is a perspective view similar to that of FIG. 2 and illustrating a second exemplary embodiment of the disclosure.
Figure 6:
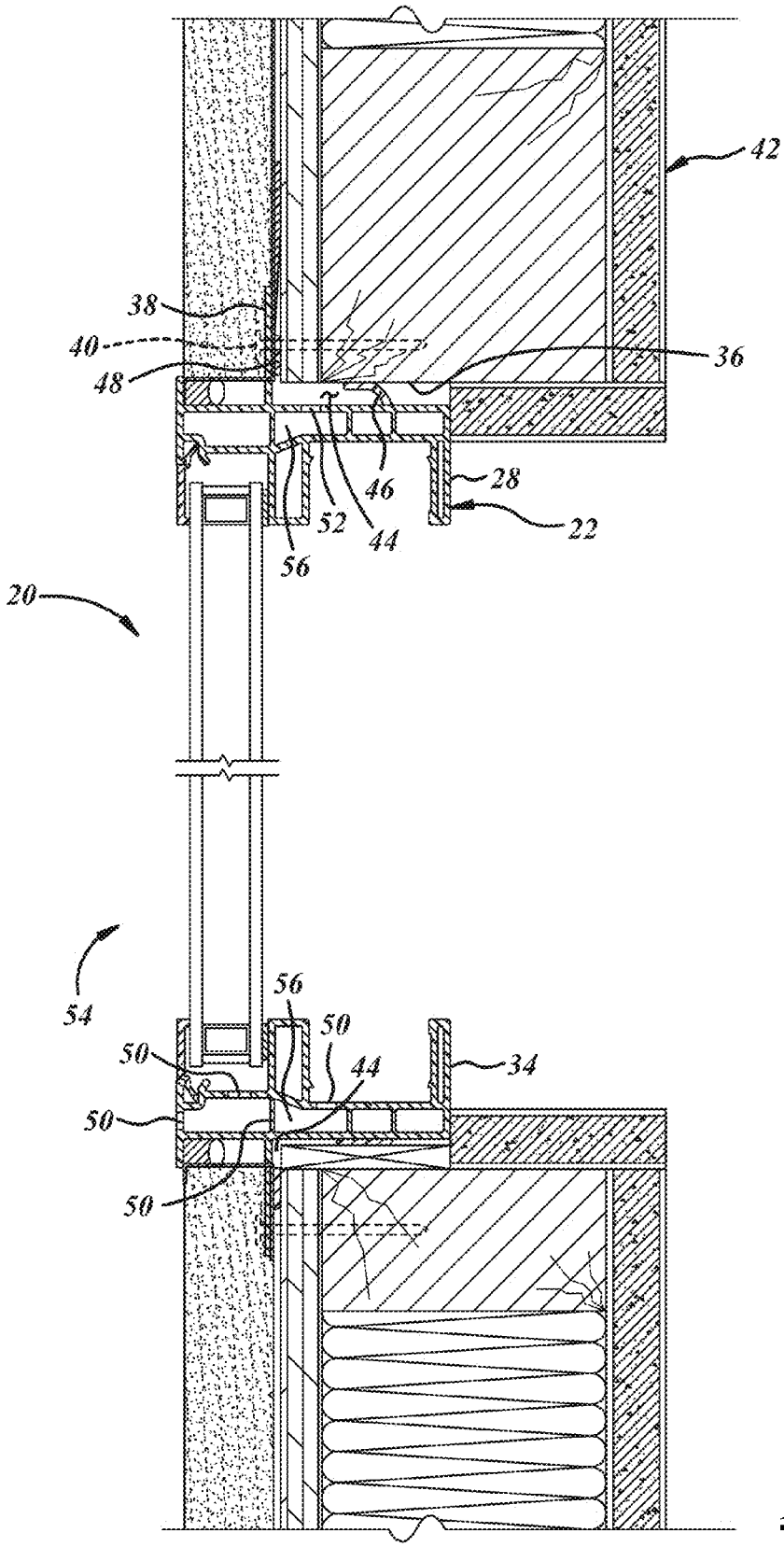
FIG. 6 is a sectional view similar to that of FIG. 3 and illustrating the modified embodiment of FIG. 5.

FIGS. 5 and 6 illustrate a modified window unit 54. Extruded rails 28, 30, 32, 34 include at least one interior chamber 56 that extends entirely around the frame from top rail 28 through side rails 30, 32 into bottom rail 34 (FIGS. 4 and 6). At least one moisture weep (drain) opening 52 (FIGS. 5 and 6) is provided in the exterior wall of at least top frame rail 28 between cavity 44 and chamber 56. Thus, any moisture that enters cavity 44 is prevented by barrier wall 46 from flowing to the building interior, and drains through opening 52 into chamber 56 and then around frame 22 and out of drain openings 50 to the building exterior.

There thus has been disclosed a building closure that fully satisfies all of the objects and aims previously set forth. The disclosure has been presented in conjunction with exemplary embodiments, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A building closure for mounting in an opening in a building wall structure, said closure including:

a frame for mounting within the building wall structure opening and at least one closure unit for mounting within said frame, said frame having at least one interior chamber extending entirely around said frame, and a nailing flange for securement to the building wall structure, a barrier extending along at least said top portion of said frame to retard passage of moisture to an interior of the building, and at least one moisture weep opening in said top portion of said frame such that moisture flows through said weep opening into said chamber, within said chamber around said frame and then out of a drain opening in a bottom portion of said frame.

2. The closure set forth in claim 1 wherein said barrier includes a wall extending at least from said top portion of said frame and said barrier wall comprises a flexible wall carried by at least said top portion of said frame for engagement with the inner periphery of the building wall structure opening.

3. The closure set forth in claim 1, including a seal on an inner surface of said nailing flange for engaging an opposing surface of the building wall structure to retard ingress of moisture.

4. The closure set forth in claim 3, wherein said at least one moisture weep opening is disposed between said barrier and said seal.

5. The closure set forth in claim 4, wherein said at least one closure unit includes a plurality of closure units, and said at least one moisture weep opening is disposed inboard of an outboard closure unit of said plurality of closure units.

6. The closure set forth in claim 1, wherein said barrier is integral with said at least said top portion of said frame wherein the barrier is not a separate component assembled to said frame.

7. A building closure for mounting in an opening in a building wall structure, said closure including:

a frame for mounting within the wall structure opening and at least one closure unit for mounting within said frame, said frame having at least one interior chamber extending around said frame, and a nailing flange for securement to the building wall structure, a seal on an inner surface of said nailing flange for engaging an opposing surface of the building wall structure to retard ingress of moisture, a barrier extending along at least said top portion of said frame to retard passage of moisture to an interior of the building, and at least one moisture weep opening in said top portion of said frame such that moisture between the seal and the barrier flows through said weep opening into said chamber, within said chamber around said frame and then out of a drain opening in a bottom portion of said frame.

8. The closure set forth in claim 7 wherein said frame comprises plural rails each having an exterior nailing flange segment, wherein said seal comprises a flexible seal wall secured on an interior surface of said nailing flange segments for engagement with a surface of the building wall structure, and wherein said barrier is secured to an exterior surface of at least a top rail of said frame.

9. The closure set forth in claim 8 wherein said rails are of extruded plastic construction and said flexible seal walls are coextruded with said rails.

* * * * *